US005302119A

United States Patent [19]

Bartoletto et al.

[11] Patent Number: 5,302,119

[45] Date of Patent: Apr. 12, 1994

[54] HOT CEMENT CLINKER COOLER POCKET GRATE

[76] Inventors: A. J. Bartoletto, 1975 Tuckaway, Bloomfield Hills, Mich. 48302; Ronald W. T. Birchard, 385 Church St., Beaconsfield, Quebec, Canada, H9W 3R5

[21] Appl. No.: 982,997

[22] Filed: Nov. 30, 1992

[51] Int. Cl.[5] ..... F27D 15/02; F23B 1/22

[52] U.S. Cl. ..... 432/77; 432/80; 110/281; 110/282; 34/164

[58] Field of Search ..... 110/281, 282; 34/164; 432/77, 80

[56] References Cited

U.S. PATENT DOCUMENTS

| | | | |
|---|---|---|---|
| 4,103,627 | 8/1978 | Mainka | 110/281 |
| 4,170,183 | 10/1979 | Cross | 110/281 |
| 4,172,425 | 10/1979 | Sheridan | 110/281 |
| 4,460,333 | 7/1984 | Longanetti | 432/80 |
| 4,510,873 | 4/1985 | Shigaki | 110/282 |
| 5,197,397 | 3/1993 | Yamagishi et al. | 110/282 |

*Primary Examiner*—Henry C. Yuen
*Attorney, Agent, or Firm*—Lloyd M. Forster

[57] ABSTRACT

Cooler pocket grate for use in conveying hot clinker from discharge end of cement kiln to cooled clinker processing area. Alternate stationary and moving grates constructed as stainless steel castings are provided with upper surface ridges having through holes for fan driven cooling air from underlying cooler bed compartments. Intermediate pockets between ridges retain clinker which serves as a grate wear resistant interface with kiln discharged hot clinker conducted along the cooler bed.

18 Claims, 3 Drawing Sheets

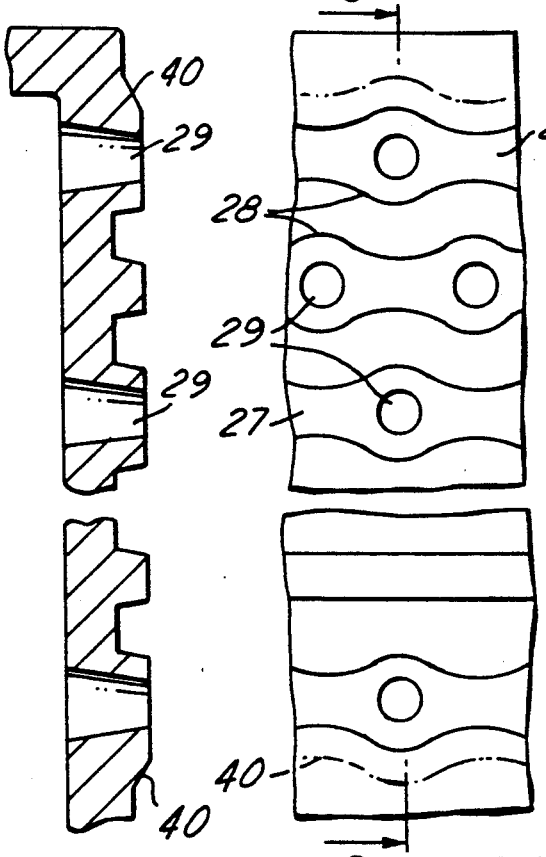
FIG.9
FIG.8
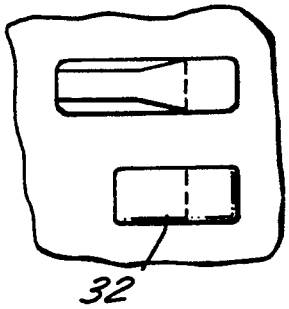
FIG.12
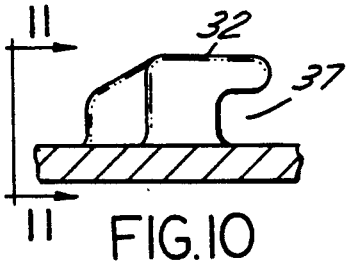
FIG.10
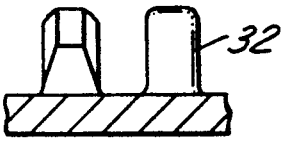
FIG.11
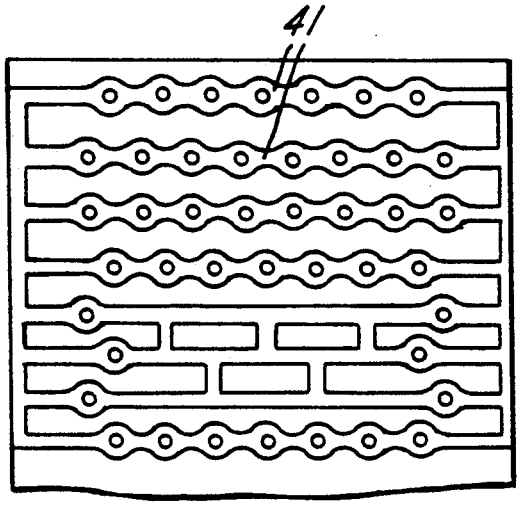
FIG.13
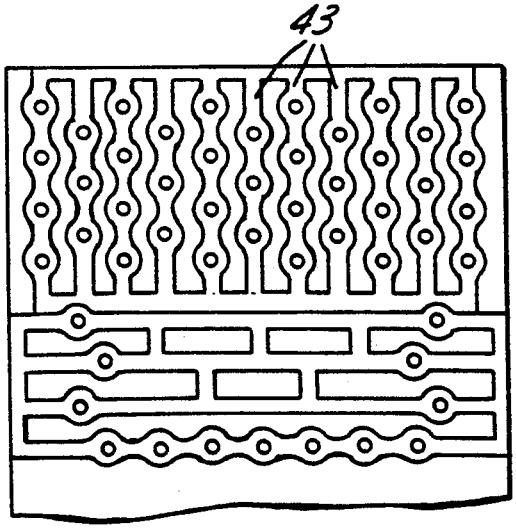
FIG.14

HOT CEMENT CLINKER COOLER POCKET GRATE

BACKGROUND OF THE INVENTION

It is known in the art to provide air cooled grates for progressive cooling of hot cement clinker discharge from the end of a cement kiln. The most relevant prior art for the purpose is disclosed in U.S. Pat. No. 4,460,333 filed on Aug. 26, 1982. Such patent discloses a modular cooler grate unit comprising a cast metal plate provided with a depending pusher flange extending across the front end thereof. The plate is provided with a plurality of air hole openings extending vertically and horizontally therethrough. On the bottom side of the plate, a plurality of ribs or fins extend lengthwise thereof between the successive rows of holes. The fins are of zigzag configuration so that they undulate between the successive holes in the adjacent rows. Such grates are employed in a cooling bed which consists of a plurality of side by side columns of overlapping rows of perforated grates through which air is directed upwardly. The hot clinker discharged from a cement kiln is advanced along the bed of grates by horizontally reciprocating alternate rows of grates relative to adjacent stationary rows of grates. The cooler grates are subject to high temperature, high corrosion and abrasion during the process of cooling the clinker.

BRIEF DESCRIPTION OF THE PRESENT INVENTION

The cooler pocket grate of the present invention provides an improvement over the grate disclosed in said prior art patent in a number of respects. Ridges, preferably transverse but optionally longitudinal, are provided on the upper surface which retain a relatively stationary layer of clinker for drive engagement with a superimposed relatively movable hot clinker bed. In this manner, there is an interposed clinker surface on each grate provided for engagement by the moving clinker bed to absorb interengagement abrasion, in effect against its own medium, thereby extending wear-life of the cast steel grates. The ridge pockets retaining the clinker material are cooler than the transported hot bed of the material, thereby reducing the heat gain transmitted to the grates. The cooling holes are located in and through the ridges where the metal is the thickest, and thereby produce the coolest practical grate temperature. Such cooling holes located through the top of the ridges cause the least disturbance to the retained material and enhance protection of the grate surface. The combination of transverse or longitudinal ridges on the upper surface and longitudinal finned lower surface, provide rigidity and substantial grate heat sink surface for improved air cooling.

BRIEF DESCRIPTION OF THE DRAWING

FIG. 8 is an enlarged fragmentary view taken along the loop line 8 of FIG. 4;

FIG. 9 is a sectional view taken along the line 9—9 of FIG. 8;

FIG. 10 is an enlarged fragmentary side elevation taken along the line 10—10 of FIG. 5;

FIG. 11 is a fragmentary end view taken along the line 11—11 of FIG. 10;

FIG. 12 is a bottom detailed view of hooks illustrated in FIGS. 10 and 11;

FIG. 13 is a fragmentary view similar to FIG. 4 illustrating optional greater separation of ridges providing enlarged intermediate pockets; and FIG. 14 is a fragmentary view similar to FIG. 4 illustrating an optional modification providing longitudinal ridges.

DETAILED DESCRIPTION OF PREFERRED EMBODIMENT

Figure 1:
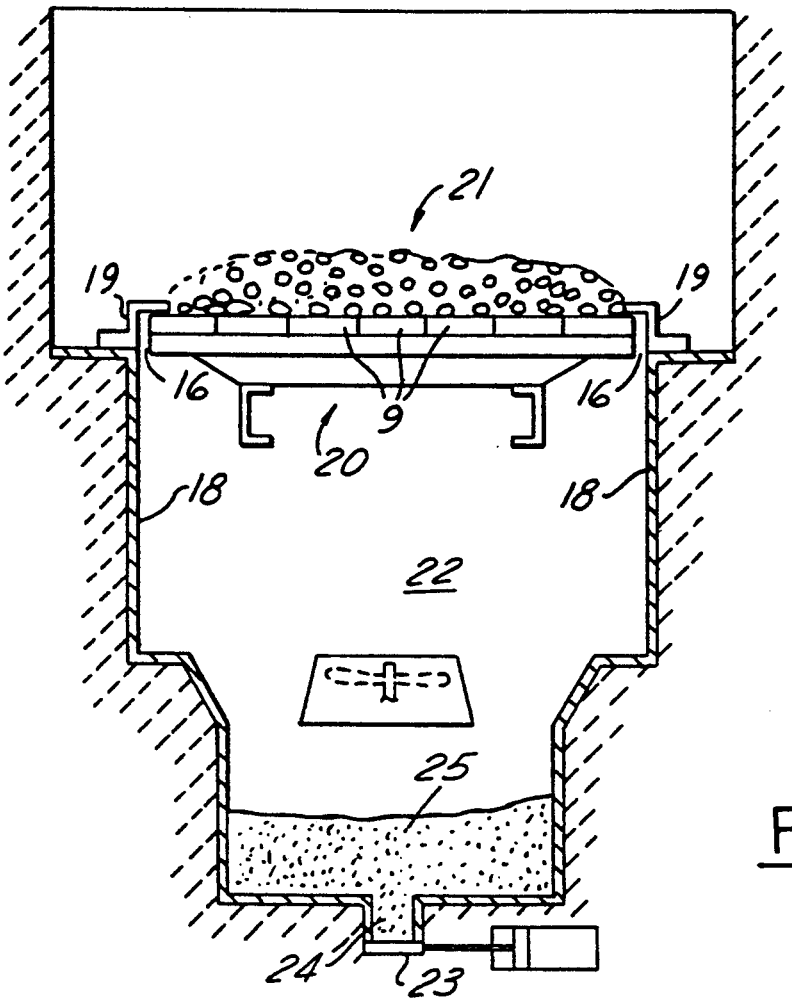
FIG. 1 is a schematic sectional view through the cooler showing a typical row of seven grates extending over a chamber of fan supplied cold air.
Figure 2:
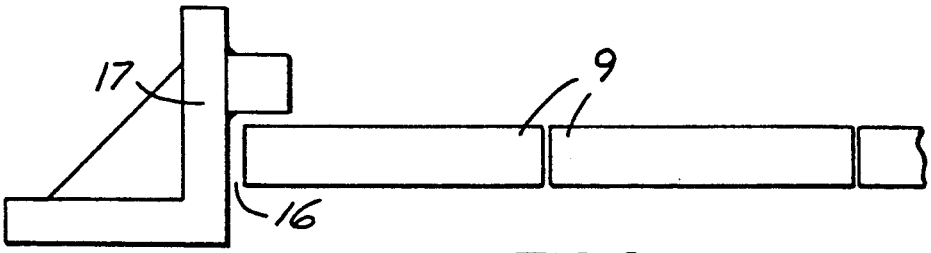
FIG. 2 is a fragmentary schematic end elevation illustrating the side by side relation of adjacent grates traveling next to a side seal structure.
Figure 3:
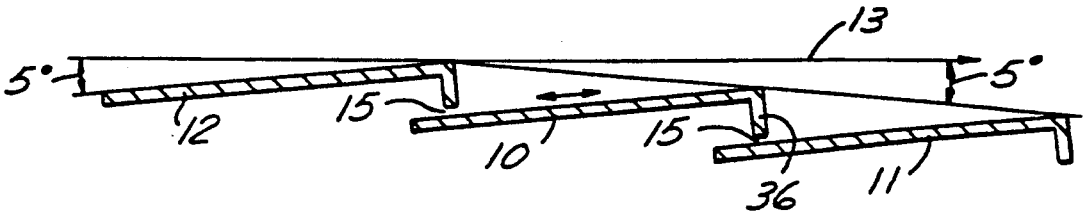
FIG. 3 discloses a schematic side elevation of three typical rows of grates illustrating the relation of a central moving grate with two stationary grates.

With reference to FIGS. 1-3, FIG. 3 illustrates schematically the overlapping relation of three rows of grates including a central row with moving grate 10 relative to a forward stationary grate 11 and rear stationary grate 12, each with a 5° upward inclination in the direction of hot clinker transmission 13 but with a 5° downward cumulative path leading to the end of the cooling bed. Optionally, the entire framework for the cooling bed may establish different angles within a limited range, e.g., from a level grate with 10° descending path to a 10° upward grate inclination with a level path.

Typically, each grate is in the order of 16¼ inches long, 12 inches wide and ½ inch thick with the moving grate having up to a 5 inch total stroke advancing the clinker bed through engagement by friction due to weight of the bed and by the nose flange 36 of the moving grate having gap 15 in the order of 3/16 inch is maintained at the overlap between adjacent grates as well as at 16 relative to side guides 17 and frame sides 18. Such air gap is appropriate for grates having the foregoing dimensions.

With reference to FIG. 1, shown in reduced scale relative to FIGS. 2 and 3, a row of seven grates 9 is illustrated between a pair of stationary side guides 19 shown enlarged with detail at 17 in FIG. 2 with moving grates reciprocated by moving frame 20. Hot clinker 21 transported on the grates is cooled by fan supplied cold air in a series of plenum chambers 22, each having a length within a range of 3-18 feet, extending under the hot clinker bed. Valve 23 under drain port 24 is adapted to control withdrawal of clinker dust 25 settling at the bottom of plenum chambers 22.

Figure 4:
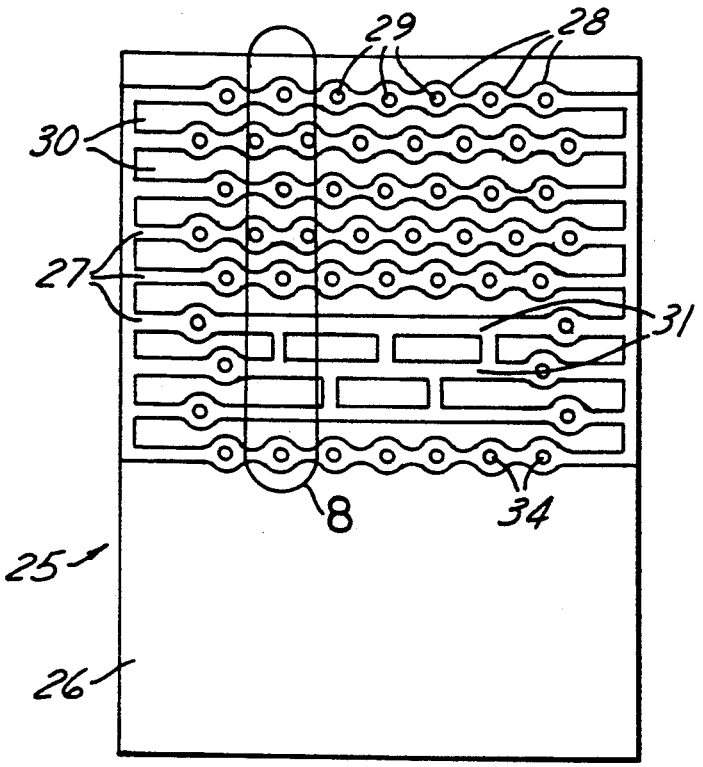
FIG. 4 is a plan view of a single pocket grate unit illustrating transverse ridges of the present invention with holes projecting therethrough.
Figure 7:
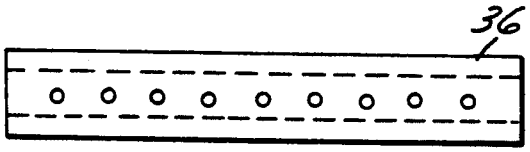
FIG. 7 is an end view of the pocket grate shown in FIG. 5.

With reference to FIG. 4, the plan view of pocket grate 25 discloses rectangular plate 26 provided over the leading half of its length with eight transverse ridges 27. The leading five of such ridges include alternately seven or eight bulges 28, each having a through hole 29 with bulges and holes in adjacent ridges relatively staggered to provide undulating grooves 30 adapted to receive and retain a surface layer of clinkers projecting above the top surface of the ridges.

Figure 5:
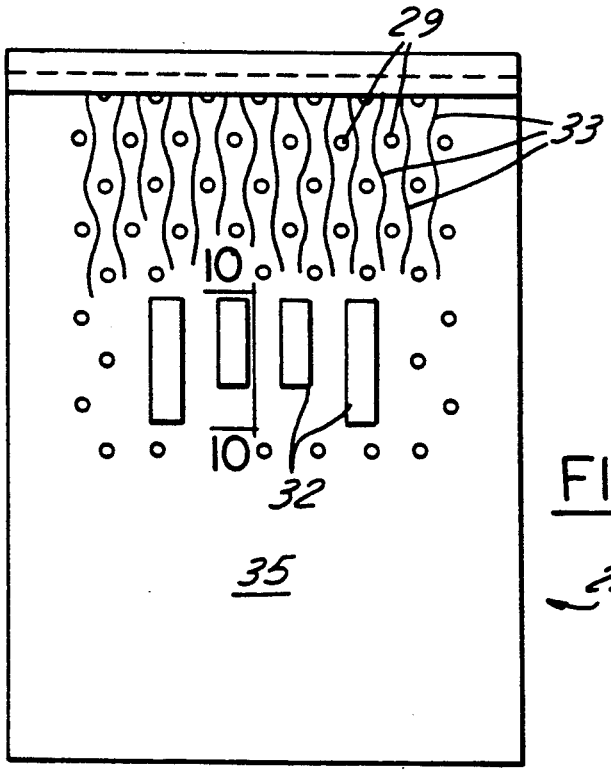
FIG. 5 is a bottom view of the pocket grate shown in FIG. 4.
Figure 6:
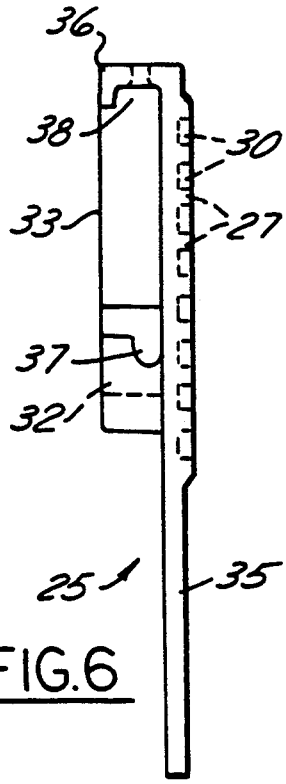
FIG. 6 is a side view of the pocket grate shown in FIG. 5.

In a limited central portion of the grate, straight sections 31 of the ridges are provided without holes in an area where hooks 32 are provided on the underside as shown in FIGS. 5 and 6. In the undersurface shown in FIG. 5, longitudinal undulating ribs or fins 33 extend between the staggered holes 29 terminating in the area of hooks 32 and short of the last central ridge holes 34. The rear half 35 of each pocket grate 25 is free of ridges, fins, and holes, to provide a plate extension for relative reciprocating clearance of pusher flanges 36 as shown in the schematic view of FIG. 3.

With reference to FIGS. 8 and 9, a fragmentary detail of holes and ridges taken along the line 8 of FIG. 4 is shown in enlarged scale, where typical dimensions can be described. In a typical pocket grate, having an overall length of 16¼ inches and width of 12 inches, a lateral spacing of ridge holes 29 of 1¼ inches and longitudinal spacing of holes in adjacent ridges of 1 inch is illustrated with holes of ⅜ inch top diameter and 8° per side draft (16° included angle) with general grate plate thickness of ½ inch; thickness under groove of ⅜ of an inch; and ridge height of ¼ inch. A 30° slope 40 is provided at the leading and trailing extremities of the first and last ridge to facilitate movement under the clinker bed.

The result is an air cooled area of approximately 8 by 8½ inches in the leading half of each grate. Fin depth extending below the general grate plate surface of approximately 1½ inches provides an extensive surface cooling area below the grate and the cooling air holes located in the ridges produce the coolest possible grate temperature.

With reference to FIGS. 10 through 12, drive hooks 32 projecting from the bottom of the grate are provided with hook recesses 37 cooperating with T-bolts to pull location blocks 39 against the face of the grate support 40 to provide for drive engagement by a moving frame 20 schematically illustrated in FIG. 1. Flange recess 38 allows for a support finger to carry the weight on the grate. It will be understood that stationary grates such as 11 and 12 in FIG. 1, which do not require drive, are anchored to the stationary frame by the same type of T-shaped bolts, engaging hooks 32.

With reference to FIG. 13, an optional modification provides greater separation of ridges 41 with larger intermediate pockets adapted to accommodate larger clinker size retention.

With reference to FIG. 14, an optional modification provides longitudinal ridges 43 with a different clinker retention effect appropriate in certain cases.

From the foregoing description, it will be understood that the upper ridged pocket grate surface uses retained clinker material to interface with the driven clinker bed thereby protecting the metal grate surface per se and extending the wear life of the grate for longer service. Ridges are applied in such a manner that this improved form of pocket grate can be used in place of prior grates without cooler modification. Cooling holes are sized to give equivalent resistance to air flow as in prior grates; however, the cooled material is retained on the pocket surface of the grate to reduce heat gain in this new style of pocket grate. The cooling holes are located in the areas where the metal is the thickest and thus produce the coolest feasible temperature. As a result, the metal in the grate will operate at a lower temperature than an ordinary grate and thus be harder and wear longer.

Cooling holes are located on top of the ridges to cause the least disturbance to the retained material and enhance the protection of the grate surface. The wear resistance of the upper surface of the pocket grate may be further enhanced by use of industrial hard chrome plating to inhibit the start of abrasive wear and further extend the surface life of the new grate. The ridges and/or finning may be straight, zigzagged or serpentine to produce the desired pockets for material retention.

Kilns 200 to 700 feet in length with diameters ranging from 4½ to 25 feet discharge clinkers having temperatures as high as 2200 to 2700° F. The present air cooled pocket grate construction provides grate temperature at the receiving end of 500° F. with capability of 2000° F. max. With cooling beds of 30–50 foot length and 5–13 foot width, discharge end temperature of the grates preferably reaches less than 200° F. Lower grate operating temperature will reduce or prevent high temperture deformation of the grate and will prevent or greatly reduce oxidation or corrosion thereby accordingly extending the service life of the grate.

The use of longitudinal sides joining transverse ridges will add rigidity and aid in retaining clinkers to protect the surface of the grate. The clinker height on the cooling bed may range from 12 to 24 inches with reciprocating cycle time established to accommodate the discharge rate of particular cement kilns.

It should be noted that pocket grates may be used with the top ridges and no bottom fins in areas where less cooling is needed further down the cooler.

We claim:

1. Cooler pocket grate for longitudinal progressive transport of hot clinker on cooling bed, alternating rows of grates having overlapping alternating movable and stationary grates, each row of stationary grates being secured to stationary frame means (18), each row of movable grates being reciprocated by moving frame means (20) characterized by said grates having pocket grate construction with upper surface spaced ridges providing between said ridges intermediate surface clinker retention pockets for clinker-to-clinker drive engagement with superimposed hot clinker bed.

2. Cooler pocket grate of claim 1 including cooler holes extending through said ridges.

3. Cooler pocket grate of claim 2 wherein said cooling air holes are spaced along each ridge with an arcuate ridge enlargement at each hole.

4. Cooler pocket grate of claim 3 wherein hole spacing of alternate ridges is staggered to provide serpentine grooves between adjacent ridges for clinker material retention.

5. Cooler pocket grate of claim 4 wherein said holes are provided with upward narrowing conical draft tapers.

6. Cooler pocket grate of claim 2 wherein fins project from the bottom surface of each grate extending longitudinally between the cooling holes.

7. Cooler pocket grate of claim 6 wherein said fins extend longitudinally and in serpentine configuration between the staggered holes.

8. Cooler pocket grate of claim 2 wherein the longitudinal hole spacing between adjacent ridges is approximately 1 inch.

9. Cooler pocket grate of claim 2 wherein transverse hole spacing in each ridge is approximately 1¼ inches.

10. Cooler pocket grate of claim 2 wherein the ridge height is approximately ¼ inch.

11. Cooler pocket grate of claim 2 wherein the groove width between adjacent ridges is approximately $\frac{3}{8}$ of an inch.

12. Cooler pocket grate of claim 11 wherein the hole diameter at the upper discharge surface is approximatley $\frac{3}{8}$ of an inch.

13. Cooler pocket grate of claim 12 with a grate thickness through the ridge of approximately $\frac{2}{3}$ of an inch.

14. Cooler pocket grate of claim 13 wherein each hole diameter has approximately an 8° side draft, 16° included angle.

15. Cooler pocket grate of claim 7 constructed of stainless steel casting.

16. Cooler pocket grate of claim 15 having hard chrome plating skin surface.

17. Cooler pocket grate of claim 1 including transverse upper surface ridges.

18. Cooler pocket grate of claim 1 including longitudinal upper surface ridges.

* * * * *

UNITED STATES PATENT AND TRADEMARK OFFICE

CERTIFICATE OF CORRECTION

PATENT NO. : 5,302,119

DATED : April 12, 1994

INVENTOR(S) : A.J. Bartoletto and R.W.T. Birchard

It is certified that error appears in the above-identified patent and that said Letters Patent is hereby corrected as shown below:

Column 2, line 46, after "having", insert -- a depth within a range of 3 to 3-1/4 inches for different models. An air --

Signed and Sealed this

Fifteenth Day of November, 1994

*Attest:*

Bruce Lehman

BRUCE LEHMAN

*Attesting Officer*

*Commissioner of Patents and Trademarks*